US005768856A

United States Patent [19]

Odenthal

[11] Patent Number: 5,768,856

[45] Date of Patent: Jun. 23, 1998

[54] LOADING A PLURALITY OF PACKAGES INTO A BOX

[75] Inventor: Heinz F. Odenthal, Zülpich, Germany

[73] Assignee: Ostma Maschinenbau GmbH, Zulpich, Germany

[21] Appl. No.: 761,158

[22] Filed: Dec. 6, 1996

[30] Foreign Application Priority Data

Dec. 7, 1995 [DE] Germany ..... 295 19 365 U
Nov. 18, 1996 [EP] European Pat. Off. ..... 96118452

[51] Int. Cl.[6] ..... B65B 35/30

[52] U.S. Cl. ..... 53/443; 53/152; 53/247; 53/251; 53/252; 53/447; 53/448; 53/493; 53/498; 53/540; 198/430

[58] Field of Search ..... 414/790, 790.1, 414/790.3; 198/429, 430, 689.1; 53/152, 247, 251, 252, 443, 500, 447, 448, 493, 498, 534, 540, 542

[56] References Cited

U.S. PATENT DOCUMENTS

| | | | |
|---|---|---|---|
| 3,370,549 | 2/1968 | Livingston | 53/540 X |
| 3,822,528 | 7/1974 | Carlsson et al. | 53/542 |
| 3,889,801 | 6/1975 | Boyer | 198/689.1 |
| 3,954,165 | 5/1976 | Snyder | 53/152 X |
| 4,250,688 | 2/1981 | Lingenfelder | 53/542 X |
| 4,399,905 | 8/1983 | Lance et al. | 198/430 |
| 4,577,453 | 3/1986 | Hofeler | 53/443 X |
| 4,712,356 | 12/1987 | Hardage et al. | 53/542 X |
| 4,927,322 | 5/1990 | Schweizer et al. | 53/152 X |
| 4,982,550 | 1/1991 | Tisma | 53/251 X |
| 5,018,334 | 5/1991 | Guttinger et al. | 53/152 |
| 5,176,244 | 1/1993 | Radzins et al. | 198/430 |
| 5,261,522 | 11/1993 | Guttinger et al. | 198/430 X |
| 5,460,258 | 10/1995 | Tisma | 198/430 |

FOREIGN PATENT DOCUMENTS 0 551 613 7/1993 European Pat. Off. .

*Primary Examiner*—Daniel Moon
*Attorney, Agent, or Firm*—Herbert Dubno; Andrew Wilford

[57] ABSTRACT

Packages arriving continuously one after the other at an input station are loaded into boxes by continuously displacing an endless pocket belt through the input station and loading the packages at the input station into respective pockets of the belt. At a transfer station offset along the belt from the input station groups of the packages in the pockets are displaced transversely of the belt out of the respective pockets while the packages are still being displaced parallel to and synchronously with the belt at least until the packages being displaced transversely are clear of the pocket belt. These groups of packages displaced out of the respective pockets of the belts are then loaded into respective boxes.

12 Claims, 4 Drawing Sheets

LOADING A PLURALITY OF PACKAGES INTO A BOX

SPECIFICATION

1. Field of the Invention

The present invention relates to loading of a plurality of packages into a box. More particularly this invention concerns the loading of packages arriving continuously one after the other groupwise into boxes.

2. Background of the Invention

It is well known in the art from EP 0,551,613 and U.S. petent application Ser. No. 08/498,941 (now U.S. Pat. No. 4,588,285 issured 31 Dec. 1996) to load packages arriving one after the other in a row from a production line into a succession of containers or boxes, with each box holding a plurality of the packages arranged in a row next to one another. The packages, for instance relatively stiff bags of breakfast food or candy, arrive one after the other and must be arranged in groups that are transferred to respective boxes.

In order to allow the boxes to be moved into and out of position without interrupting the inflow of packages, it is necessary to provide a complex conveyor arrangement that speeds up and slows down the packages between the input location and the transfer location. This can be done by a plurality of belt-type conveyors at least one of which is operated at two different speeds so that it can take in the packages one after the other at regularly spaced intervals and output them periodically as tightly spaced groups.

Alternately a single pocket belt is used which is set up so that it can be arrested where it passes through the transfer station while it still moves in the input station. Two different servomotors are needed to achieve this effect so that the device is fairly complex. Furthermore the packages are subjected to a stop-and-go operation which can result in them becoming dislodged or otherwise malpositioned to jam the system.

Such arrangements are quite complex and occasionally jam, requiring that the entire production line be shut down while the jam is cleared. The acceleration and deceleration of the packages must be executed with great precision to prevent the packages from getting canted or malpositioned, so that the machinery is quite sensitive and complex.

OBJECTS OF THE INVENTION

It is therefore an object of the present invention to provide an improved system for loading continuously arriving packages as groups into boxes.

Another object is the provision of such an improved system for loading continuously arriving packages as groups into boxes which overcomes the above-given disadvantages, that is which is simple both with respect to the mechanism involved and the movements the packages are subjected to.

SUMMARY OF THE INVENTION

Packages arriving continuously one after the other at an input station are loaded into boxes by continuously displacing an endless pocket belt through the input station and loading the packages at the input station into respective pockets of the belt. At a transfer station offset along the belt from the input station groups of the packages in the pockets are displaced transversely of the belt out of the respective pockets while the packages are still being displaced parallel to and synchronously with the belt at least until the packages being displaced transversely are clear of the pocket belt. These groups of packages displaced out of the respective pockets of the belts are then loaded into respective boxes.

Thus with this system there is no stop-and-go operation of the pocket belt or any portion thereof. Instead the belt runs continuously and the packages are displaced out of its pockets while they continue to move with the belt. As a result of this operation there is little likelihood of jamming.

According to the invention the boxes are displaced one after another continuously through a loading station adjacent the transfer station. They are displaced parallel to and synchronously with the packages in the transfer station. Thus the transfer from the pocket belt to the boxes can be very smooth.

The spacing between succeeding packages as they arrive at the input station is sensed and an advance speed of the pocket belt is controlled in accordance with the sensed spacing so that every pocket of the belt is filled. Thus if there is a slowdown upstream, the box loader will slow down to compensate instead of partially filling boxes. Normally the belt is advanced at a predetermined belt-travel speed and the packages are displaced out of the pockets by a gripper. This gripper is displaced in a direction forming an acute angle with a direction of displacement of the belt through the transfer station at a gripper speed having a speed vector parallel to the direction of displacement of the belt through the transfer station equal to the predetermined belt-travel speed. In actual use the gripper is accelerated to the gripper speed and then is brought into engagement with the packages to be transferred. Thus the packages are never suddenly braked or accelerated until they are actually loaded into their box.

In the apparatus for carrying out the method of this invention the transfer unit includes a conveyor belt passing through the transfer station and carrying a succession of the boxes. This conveyor belt is perforated and the transfer unit further includes a suction box underneath the conveyor belt adhering the boxes thereto.

It is also possible for the transfer unit to include a main gripper displaceable at an acute angle to the belt in the transfer station and an actuator for displacing the gripper at an acute angle to the belt at a rate such that a speed vector of the gripper parallel to the belt is equal to a displacement speed of the belt. This main gripper includes a slide displaceable at the acute angle to the belt and a pair of gripper bars extending parallel to the belt in the transfer station and laterally engageable with the packages in the pockets of the belt in the transfer station.

The transfer unit can include a conveyor belt passing adjacent the transfer station and carrying a succession of the boxes and another transfer device for pulling the packages held by the gripper out of the gripper and depositing them in the boxes or in an intermediate holder that collects several groups of the packages. Such a transfer device can be a secondary griper pivotal between the main gripper and the boxes on the conveyor belt.

The pocket belt according to the invention includes a flat belt, a plurality of partitions spaced apart along and projecting transversely from the flat belt, and clamps securing the partitions to the flat belt. The clamps are releasable and movable along the flat belt. The partitions are of spring steel.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
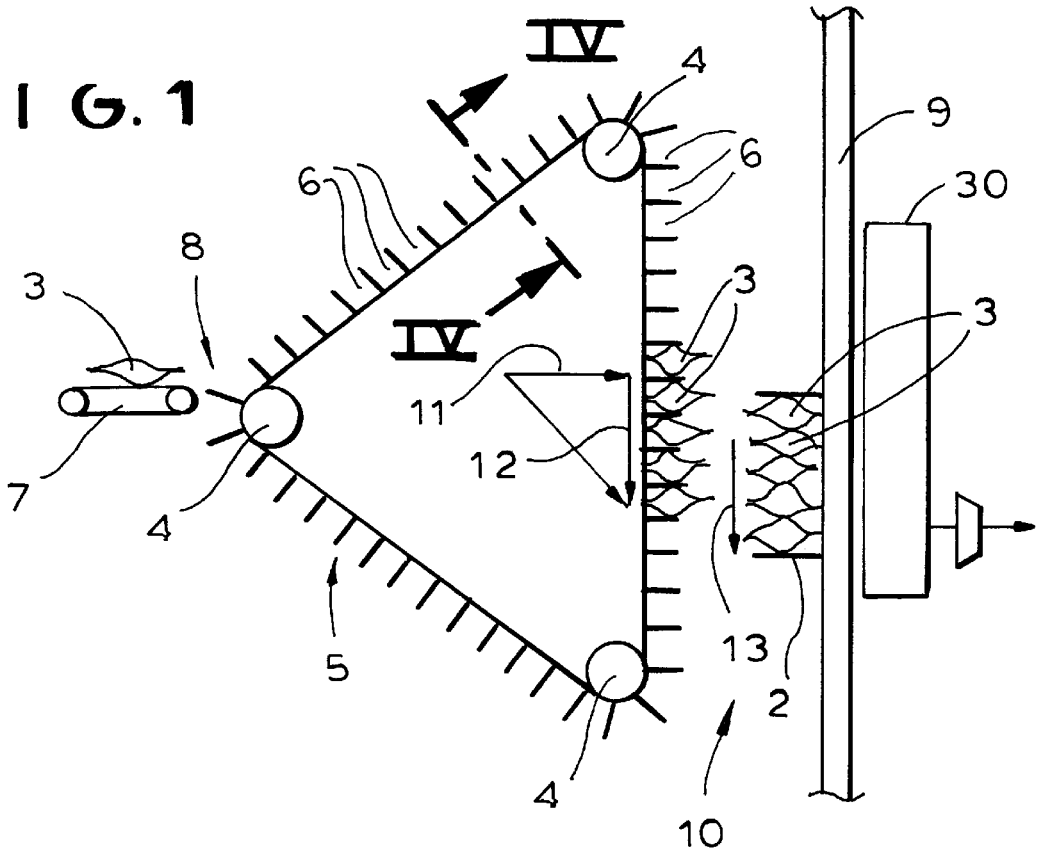
FIG. 1 is a largely schematic view of an apparatus according to the invention.

As seen in FIG. 1 an apparatus 1 loads individual packages 3, here relatively stiff bags of particulate material, into containers 2, here open-topped cardboard boxes. The packages 3 arrive one after another on a continuously moving conveyor belt 7 at an input station 8 where they are transferred to individual pockets 6 of an endless pocket belt 5 spanned over three rollers 4. The boxes 2 are displaced continuously one after another through a loading station 10 by a conveyor belt 9 that extends parallel to a straight stretch of the belt 5 with the belt 9 moving in a direction 13 at the same speed as the belt 5. This belt 9 is perforated and is juxtaposed at the station 10 with a suction box 30 that ensures that the boxes 2 sit stably on it. At the station 10 groups of the packages 3 are displaced transversely of the belt 5 as indicated by arrow 11 and parallel to the belt 5 as indicated by vector arrow 12 so that each such group is moved into a respective box 2.

Figure 4:
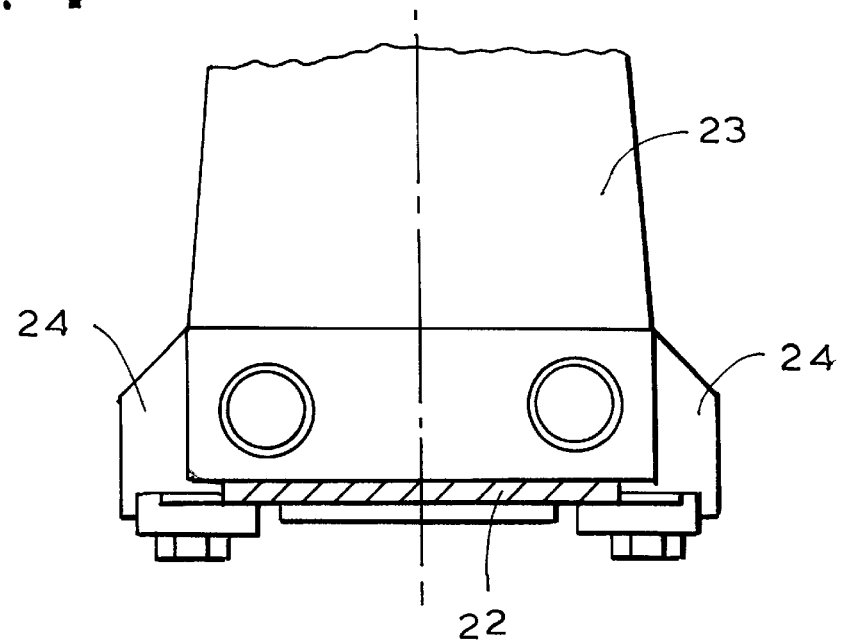
FIG. 4 is a large-scale cross section taken along line I—IV of FIG. 1.
Figure 5:
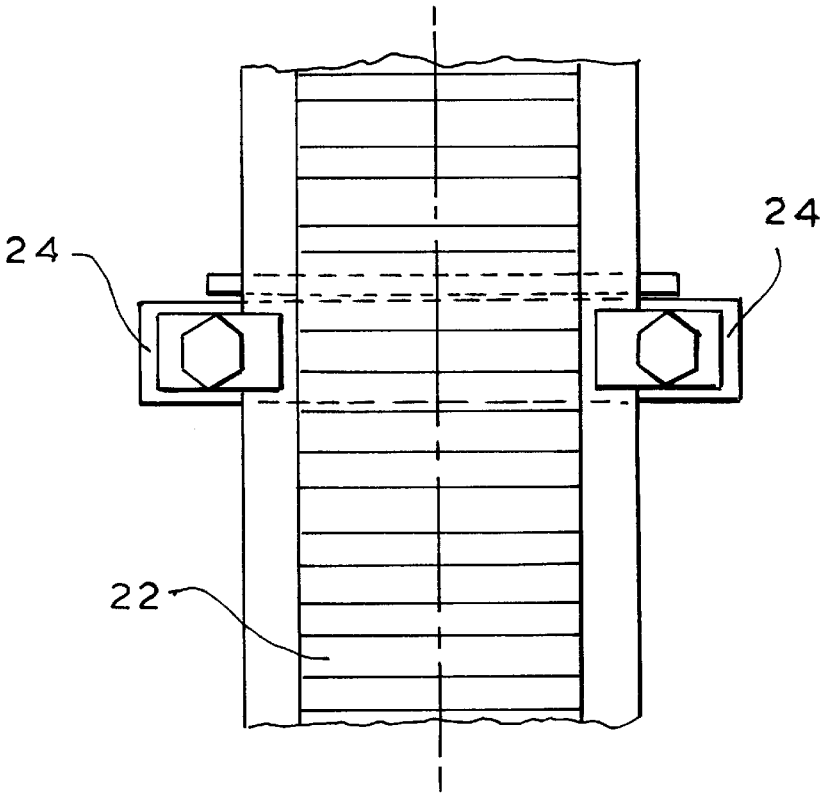
FIG. 5 is a top view of the detail shown in FIG. 4.

As shown in FIGS. 4 and 5 the belt 5 comprises a flat belt 22 to which spring-steel pocket-forming partitions 23 are secured by clamps 24. Thus it is possible to move these partitions 23 along the belt 5 to set it for packages 3 of different thicknesses.

Figure 2:
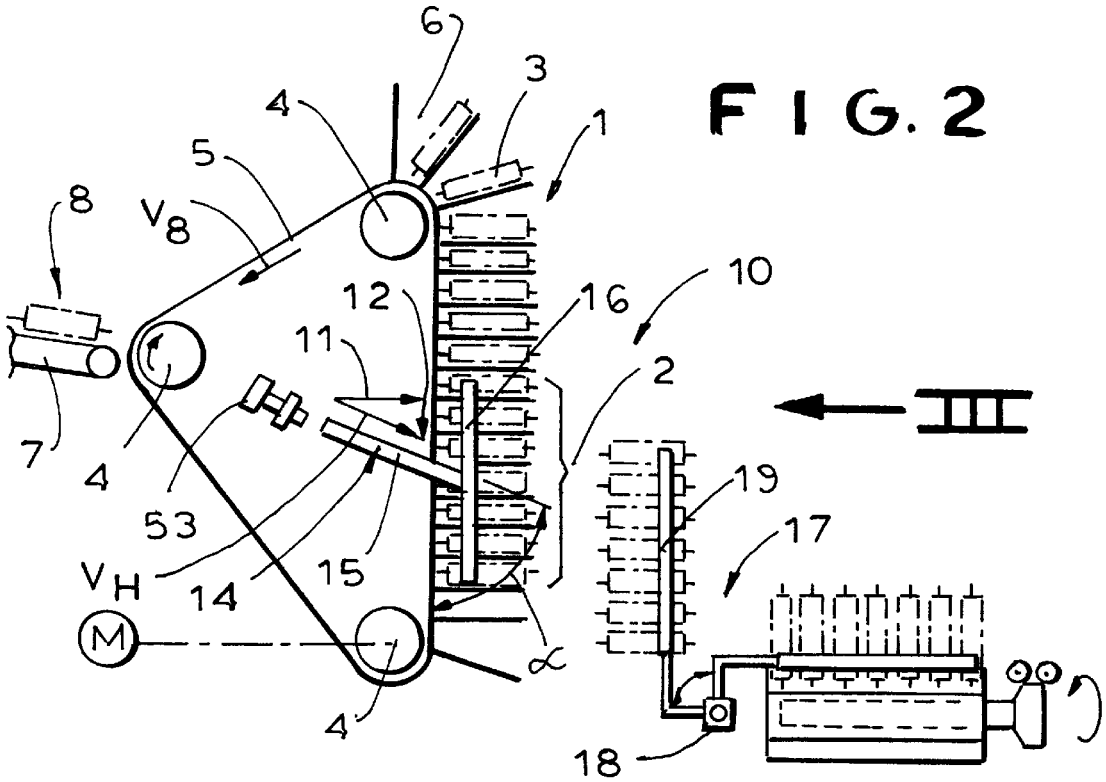
FIG. 2 is a view like FIG. 1 showing an alternative apparatus.
Figure 3:
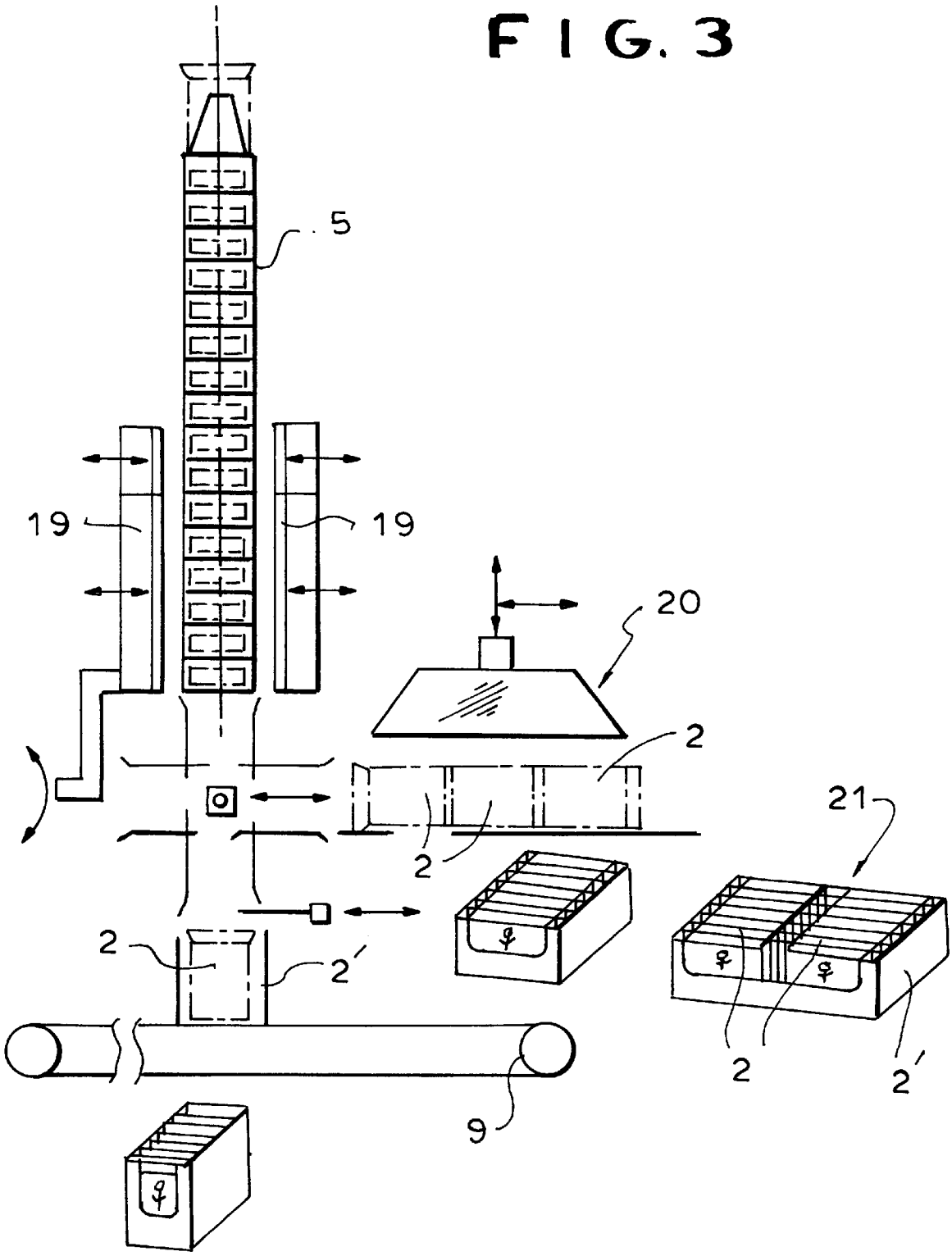
FIG. 3 is a side view taken in the direction of arrow III of FIG. 2.

More particularly as shown in FIGS. 2 and 3 a loading device 14 comprises a pair slider arms 15 flanking the belt 5, extending at an angle $\alpha$ to the straight section of the belt 5 in the station 10, and carrying on their outer ends gripper bars 16 extending parallel to the belt 5 and capable of laterally engaging and grasping the packages 3 held in the pockets 6. The slider arms 15 are displaced with a speed $V_H$ such that the bars 16 move in the direction 12 with a speed equal to the advance speed $V_B$ of the belt 5.

While in FIG. 1 the packages 3 are moved from the belt 5 directly to the cartons 2, in FIG. 2 they are transferred to a gripper 19 of a transfer device 17 pivotal about a horizontal axis 18. This gripper 19 can deposit the packages directly in the boxes 2 or, as shown in FIG. 3, can hand them off to an intermediate holder 20 which allows several groups 1 to be collected in a holder 21 and deposited in a single box 2'.

Figure 6:
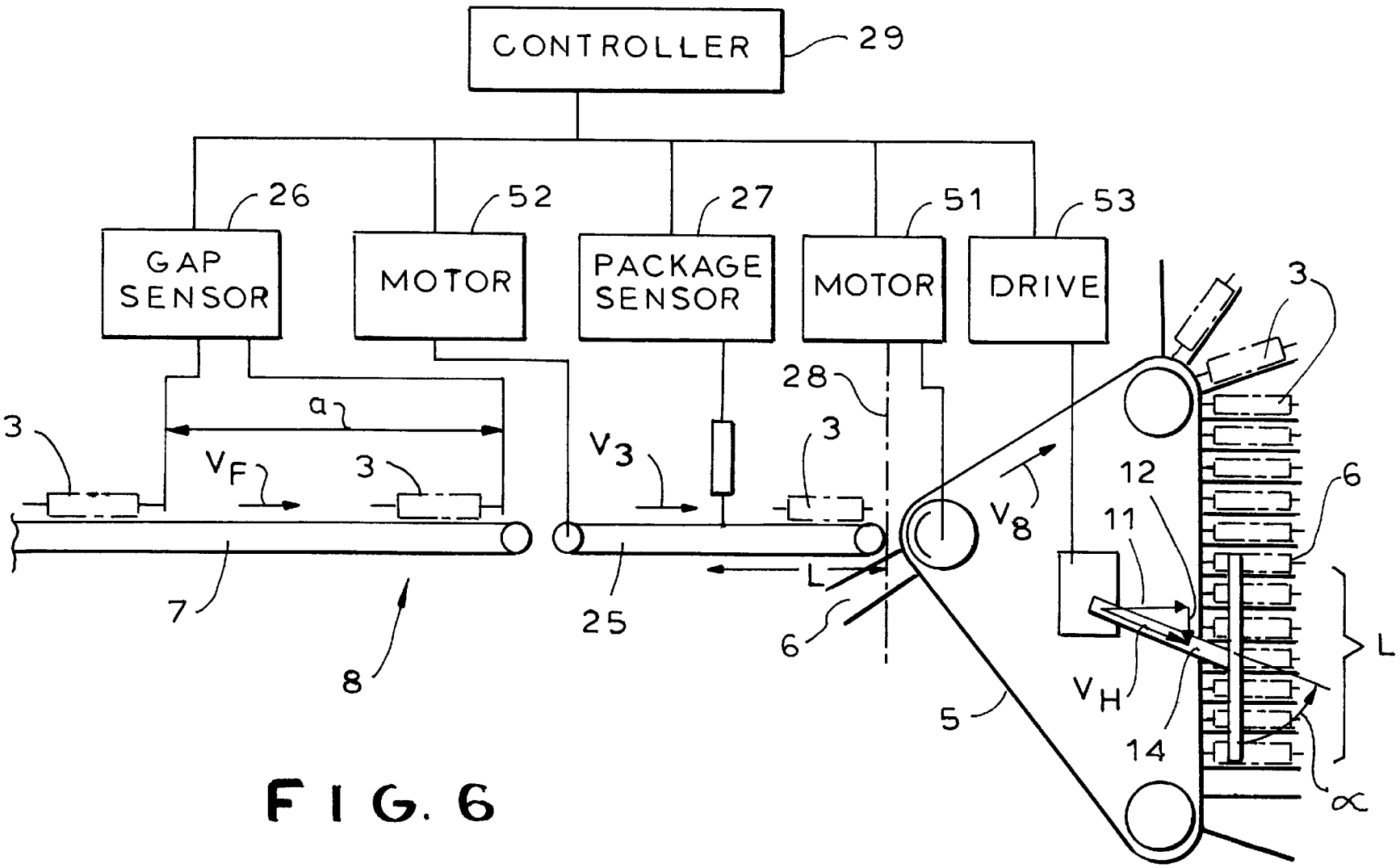
FIG. 6 is a schematic diagram illustrating the control system for the FIG. 2 system.

In the arrangement of FIG. 6 the input conveyor 7 operates at a constant speed $V_F$ determined by the upstream production machinery, is associated with a sensor 26 which determines the distance a between succeeding packages 3, and feeds these packages 3 to an intermediate input conveyor 25. A motor S2 operates this conveyor 25 at a variable speed $V_3$ and another package sensor 27 detects the passing packages 3 on the belt 25 at a predetermined spacing L downstream of the location 28 where they are loaded into individual pockets 6 of the belt 5. A central computer-type controller 29 is connected to the sensors 26 and 27 as well as to the drive motors S1 and S2 and to the actuator S3, so that this controller 29 has data concerning the size of the gaps a, the positions of packages 3 on the belt 25, and the speeds $V_3$ and $V_B$.

Since packing the packages 3 in the boxes 2 is normally the end of the production line and the speed $V_F$ is determined by upstream conditions that are not readily changed, the system adapts the box packing to the speed and spacing of the incoming packages 3. To this end the controller 29 coarsely sets the speeds $V_3$ and $V_B$ so that the packages 3, if spaced at uniform gaps a, are loaded one after another into succeeding pockets 6 with no pockets 6 left empty. Normally of course everything operates continuously. If the gap a starts to grow the downstream speeds $V_3$ and $V_B$ will be slowed sufficiently to accommodate this variation, or if the gap a starts to shrink the down-stream speeds $V_3$ and $V_B$ are correspondingly increased.

This coarse adjustment of the speeds $V_3$ and $V_B$ of the belts 25 and 5 is not, however, normally sufficient to ensure that absolutely each and every pocket 6 receives a single package 3, as it is possible for a single package or a few packages to get misaligned or even be missing. If, for instance, the sensor 27 determines that a passing package 3 is positioned such that it will not arrive at the transfer location 28 in time to get into the next empty pocket 6, the controller 29 will simultaneously increase the speed $V_3$ and decrease the speed $V_B$ to ensure that this package 3 and the pocket 6 come together perfectly. Contrarily the controller 29 will decrease the speed $V_3$ and increase the speed $V_B$ if the sensor 27 determines that the next package 3 is going to arrive at the location 28 too soon.

With this two-stage regulation—coarse setting of the speeds $V_3$ and $V_B$ in accordance with the incoming speed $V_F$ and gap a, and fine setting of the speeds $V_3$ and $V_B$ relative to each other depending on the speed $V_3$ and the package position determined by the sensor 27—it is possible to completely avoid misfills where one pocket 6 is left empty and the resultant box 2 is short one package 3. In any case the instantaneous actuation speed $V_H$ of the gripper device 14 is set at a fixed ratio to the speed $V_B$ of the belt 5.

Normally the device 14 starts to move when the belt 5 is still back by a distance equal to half the length of one of the pockets 6 and it has reached its end speed, whose vector 12 is equal to the speed $V_B$ by the time its bars 16 have actually come into contact with and grasped the group 1 of packages 3 to be transferred out. The controller 29 can also operate other devices, such as a labeling machine for the packages 3.

I Claim:

1. A method of loading packages arriving continuously one after the other at a constant input speed at an input station into boxes, the method comprising the steps of:

continuously displacing an endless pocket belt through the input station;

detecting the spacing between succeeding packages as they arrive at the input station;

displacing the pocket belt and an intermediate conveyor between the input station and the pocket belt at respective variable speeds and loading the packages at the input station onto the intermediate conveyor and from it into respective pockets of the pocket belt;

coarse setting the variable speeds in accordance with the input speed and the spacing;

detecting the spacing between the packages on the intermediate conveyor and the pocket belt;

fine setting the variable speeds relative to each other by increasing the intermediate-conveyor speed and decreasing the pocket-belt speed on detection of a package on the intermediate belt at too great a spacing from the pocket belt and by decreasing the intermediate-conveyor speed and increasing the pocket-belt speed on detection of a package on the intermediate belt at too close a spacing from the pocket belt;

at a transfer station offset along the pocket belt from the input station displacing groups of the packages in the pockets transversely of the belt out of the respective pockets with a gripper;

displacing the gripper in a direction forming an acute angle with a direction of displacement of the belt through the transfer station at a gripper speed having a speed vector parallel to a direction of displacement of the pocket belt through the transfer station equal to the pocket-belt speed; and loading the groups of packages displaced out of the respective pockets of the belts into respective boxes.

2. The method defined in claim 1, further comprising the step of displacing the boxes one after another continuously through a loading station adjacent the transfer station.

3. The method defined in claim 2 wherein the boxes are displaced parallel to and synchronously with the packages in the transfer station.

4. The method defined in claim 1 wherein the gripper is accelerated to the gripper speed and then is brought into engagement with the packages to be transferred.

5. An apparatus for loading packages, the apparatus comprising:

an endless pocket belt having a plurality of outwardly open pockets, extending through an input station, and having a straight stretch extending through a transfer station offset from the input station;

drive means for continuously displacing the pocket belt through the input and transfer stations at a variable speed;

input means including an input conveyor operating at a constant speed and an intermediate conveyor between the input conveyor and the pocket belt and operable at a variable speed for loading the packages at the input station into respective pockets of the belt;

means including a sensor associated with the input conveyor for determining the spacing between succeeding packages on the input conveyor;

means including a sensor associated with the intermediate conveyor for detecting the spacing between the packages on the intermediate conveyor and the pocket belt;

transfer means at the transfer station for displacing groups of the packages in the pockets transversely of the belt out of the respective pockets while continuing to displace the packages being displaced transversely parallel to and synchronously with the belt at least until the packages being displaced transversely are clear of the pocket belt and for loading the groups of packages displaced out of the respective pockets of the pocket belt into respective boxes, the transfer means including a slide displaceable at an acute angle to the pocket belt in the transfer station, a pair of gripper bars extending parallel to the pocket belt in the transfer station and laterally engageable with the packages in the pockets in the transfer station, and actuator means for displacing the slide at an acute angle to the belt at a rate such that a speed vector of the slide parallel to the belt is equal to the pocket-belt speed; and a central controller connected to the sensors, to the intermediate conveyor and pocket belt, and to the actuator means for controlling the variable speeds in accordance with the spacing between succeeding packages on the input conveyor and the spacing of the packages on the intermediate conveyor from the pocket conveyor and for operating the transfer means synchronously with the pocket belt.

6. The package-loading apparatus defined in claim 5 wherein the transfer means includes a conveyor belt passing through the transfer station and carrying a succession of the boxes.

7. The package-loading apparatus defined in claim 6 wherein the conveyor belt is perforated and the transfer means further includes a suction box underneath the conveyor belt adhering the boxes thereto.

8. The package-loading apparatus defined in claim 5 wherein the transfer means includes a conveyor belt passing adjacent the transfer station and carrying a succession of the boxes, secondary transfer means for pulling the packages held by the gripper bars out of the gripper bars and depositing them in the boxes.

9. The package-loading apparatus defined in claim 8 wherein the secondary transfer means includes a gripper pivotal between the slide and the boxes on the conveyor belt.

10. The package-loading apparatus defined in claim 5 wherein the pocket belt includes a flat belt, a plurality of partitions spaced apart along and projecting transversely from the flat belt, and clamps securing the partitions to the flat belt.

11. The package-loading apparatus defined in claim 10 wherein the clamps are releasable and movable along the flat belt.

12. The package-loading apparatus defined in claim 11 wherein the partitions are of spring steel.

* * * * *